US009324510B2

(12) United States Patent
Hashimoto et al.

(10) Patent No.: US 9,324,510 B2
(45) Date of Patent: Apr. 26, 2016

(54) GAS CIRCUIT BREAKER

(71) Applicant: Hitachi, Ltd., Chiyoda-ku, Tokyo (JP)

(72) Inventors: Hiroaki Hashimoto, Tokyo (JP); Kenichi Okubo, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 14/726,804

(22) Filed: Jun. 1, 2015

(65) Prior Publication Data

US 2015/0380179 A1 Dec. 31, 2015

(30) Foreign Application Priority Data

Jun. 27, 2014 (JP) ..... 2014-132017

(51) Int. Cl.

| | |
|---|---|
| ***H01H 3/46*** | (2006.01) |
| ***H01H 9/02*** | (2006.01) |
| ***H01H 3/38*** | (2006.01) |
| ***H01H 3/42*** | (2006.01) |

(52) U.S. Cl.

CPC ..... *H01H 9/0271* (2013.01); *H01H 3/38* (2013.01); *H01H 3/42* (2013.01); *H01H 3/46* (2013.01); *H01H 2235/01* (2013.01); *H01H 2239/036* (2013.01)

(58) Field of Classification Search

CPC ..... H01H 33/42; H01H 3/42; H01H 9/0027; H01H 2239/036

See application file for complete search history.

(56) References Cited

U.S. PATENT DOCUMENTS

| | | | | | |
|---|---|---|---|---|---|
| 3,794,799 | A * | 2/1974 | Spindle | H01H 5/10 | 200/446 |
| 4,996,507 | A * | 2/1991 | McKee | H01H 71/125 | 218/33 |
| 5,059,753 | A * | 10/1991 | Hamm | H01B 17/26 | 218/84 |
| 5,451,731 | A * | 9/1995 | Yoshizumi | H01H 33/168 | 218/143 |
| 5,515,018 | A * | 5/1996 | DiMarco | H01H 1/5833 | 218/22 |
| 5,808,258 | A * | 9/1998 | Luzzi | H01H 33/66207 | 218/136 |
| 2003/0117769 | A1 | 6/2003 | Yamane et al. | | |

FOREIGN PATENT DOCUMENTS

| | | | |
|---|---|---|---|
| JP | 2003-199220 | A | 7/2003 |
| JP | 3823676 | B2 | 9/2006 |

* cited by examiner

*Primary Examiner* — Truc Nguyen
(74) *Attorney, Agent, or Firm* — Crowell & Moring LLP

(57) ABSTRACT

The gas circuit breaker includes a main shaft which is a rotating shaft of a main lever connected to an opening spring, a cam shaft which is a rotating shaft of a cam connected to a closing spring, a main shaft holding member which holds the main shaft, a cam shaft holding member which holds the cam shaft, and a bracket which holds the main shaft holding member and the cam shaft holding member. A through hole is provided in a portion of the bracket between the main shaft holding member and the cam shaft holding member, and a heat generating member is provided at least on a portion of the through hole.

6 Claims, 5 Drawing Sheets

GAS CIRCUIT BREAKER

BACKGROUND OF THE INVENTION (1) Field of the Invention

The present invention relates to a gas circuit breaker and, more particularly, to a gas circuit breaker having an operating mechanism reduced in weight and capable of operating with stability even at a low temperature.

(2) Description of Related Art

As a device for operating a gas circuit breaker, a pneumatic operating device capable of obtaining operating force using pneumatic pressure, a hydraulic operating device capable of obtaining operating force using hydraulic pressure and a spring operation device capable of obtaining operating force by releasing a compressive force of a spring, i.e., an elastic member are ordinarily used.

JP-B-3823676 discloses an example of a gas circuit breaker using a spring as a drive source. This gas circuit breaker has a bearing for supporting a cam shaft and a main shaft, the bearing being provided in an operating device bracket. JP-B-3823676 shows that attachment of movable parts including a cam and a main lever outside the bracket facilitates access from the outside for inspection, replacement or the like.

As another example of a gas circuit breaker, JP-A-2003-199220 discloses a gas circuit breaker having an operating mechanism housed in an operating box 106. In ordinary cases, a gas circuit breaker has an electric heater provided in a lower section of an operating box in order to prevent freezing of instruments in the operating box in the winter.

SUMMARY OF THE INVENTION

The configurations disclosed in JP-B-3823676 and JP-A-2003-199220 have, however, the following problems. Since grease is enclosed in the bearing, there is a possibility of a delay in contact closing time with respect to contact closing time in a closing operation under an ordinary-temperature condition as a result of increase in viscosity of the grease under a low-temperature condition. In a season when the ambient temperature is below zero, the electric heater for prevention of freezing of instruments is actuated. However, a heater having a capacity high enough to completely conform the slide resistance of a bearing in a bracket to that under the ordinary-temperature condition is not provided in ordinary cases. Also, the size of the operating box varies depending on whether the breaker uses a phase-separation operating system or a three-phase collective operating system. In some cases, therefore, the capacity of the electric heater is possibly insufficient, similarly to the case described above.

In view of the above-described problems, an object of the present invention is to solve the above problem, specifically to provide a gas circuit breaker capable of reducing the weight of a spring operation mechanism and realizing a stable closing operation even when the ambient temperature is low, and a gas-insulated switchgear using the gas circuit breaker.

A gas circuit breaker according to the present invention includes a main shaft 4 which is a rotating shaft of a main lever 5 connected to an opening spring 26; a cam shaft 2 which is a rotating shaft of a cam connected to a closing spring 28; a main shaft holding member 1*c* which holds the main shaft 4; a cam shaft holding member 1*d* Which holds the cam shaft 2; and a bracket 1 which holds the main shaft holding member 1*c* and the cam shaft holding member 1*d*. A through hole 76 is provided in a portion of the bracket 1 between the main shaft holding member 1*c* and the cam shaft holding member 1*d*, and a heat generating member 73 is provided at least on a portion of the through hole 76.

The gas circuit breaker according to the present invention is capable of achieving both stabilization of the operation and a reduction in weight.

Other objects, features and advantages of the invention will become apparent from the following description of the embodiments of the invention taken in conjunction with the accompanying drawings.

DETAILED DESCRIPTION OF THE INVENTION

A preferred embodiment of the present invention in implementation of the present invention will be described with reference to the drawings. The following description is made solely to illustrate an embodiment of the invention with no intention to limit details of the present invention to a concrete mode of implementation described below. Needless to say, the invention itself can be variously modified as long as it is within the scope described in the appended claims.

First Embodiment

A gas circuit breaker according to a first embodiment of the present invention will be described with reference to FIGS. 1 to 5. The entire configuration of a gas circuit breaker 100 will first be described with reference to FIG. 5. The gas circuit breaker 100 is composed of a hermetically sealed tank 103 in which a breaker section is housed, an operating box 77, and other components. The hermetically sealed tank 103 is supported on leg parts 105. Insulating gas, e.g., sulfur hexafluoride ($SF_6$) gas is enclosed in the hermetically sealed tank 103 at a specified pressure.

Figure 5:
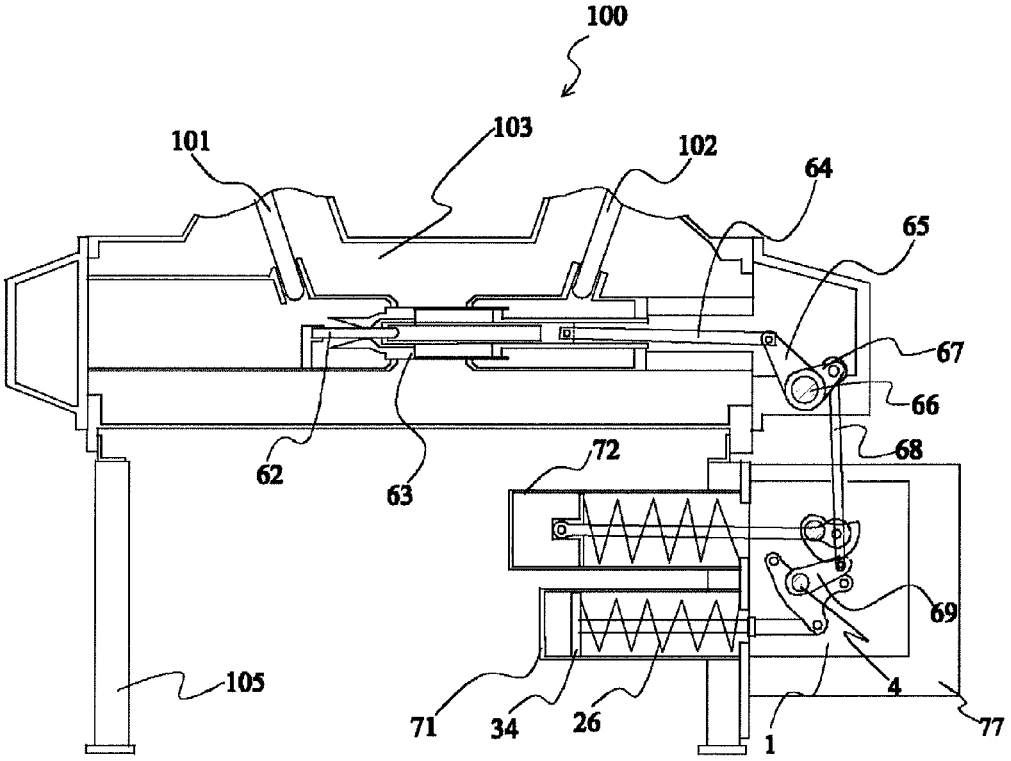
FIG. 5 shows an entire gas circuit breaker.

FIG. 5 shows a state where a connection is maintained between contacts in the breaker section, that is, a movable contactor 63 is in contact with a fixed contactor 62. In a circuit-breaking operation, the movable contactor 63 moves apart from the fixed contactor 62. The movable contactor 63 is connected to an insulating rod 64 at its end opposite from its end at which it contacts the fixed contactor 62. A rotating shaft 66 is rotatably supported on the grounded container 103. One end of a lever 65 and one end of a lever 67 are fixed to the rotating shaft 66. The other end of the lever 65 is connected to one end of the insulating rod 64. The other end of the lever 67 is connected to an output link 68. Also, one end of a lever 69 is fixed to a main shaft 4 of a spring operation mechanism. The other end of the lever 69 is connected to the link 68. The main shaft 4, the lever 69, the link 68, the lever 67, and the rotating shaft 66 form a four-link mechanism connecting the spring operation mechanism and the breaker section.

The operation of the gas circuit breaker 100 configured as described above will be described. At the time of energization, electric power is supplied from a system (not illustrated)

to a conductor 101 in a bushing on the upstream side. Electricity is led to the contacts in the grounded container 103 and is returned to the system via a conductor in a bushing 102 on the downstream side.

When an accident is caused in the system, for example, due to a thunderbolt, the spring operation mechanism is driven to rotate the main shaft 4 and the lever 69 clockwise and to thereby move the output link 68 downward. The lever 67 and the rotating shaft 66 rotate clockwise with the movement of the output link 68, thereby moving the insulating rod 64 rightward as viewed in FIG. 5. The movable contactor 63 is thereby moved apart from the fixed contactor 62 to separate the contacts and shut off the current.

While the grounded container 103 extends horizontally in the present embodiment, the grounded container 103 may alternatively extend vertically. While the single gas circuit breaker having bushings directly attached to the grounded container 103 is described, the gas circuit breaker of the present invention may alternatively be a circuit breaker incorporated in a gas-insulated switchgear. While the gas circuit breaker using $SF_6$ gas is described by way of example, the present invention may be applied to any other switchgear such as a vacuum circuit breaker.

Figure 1:
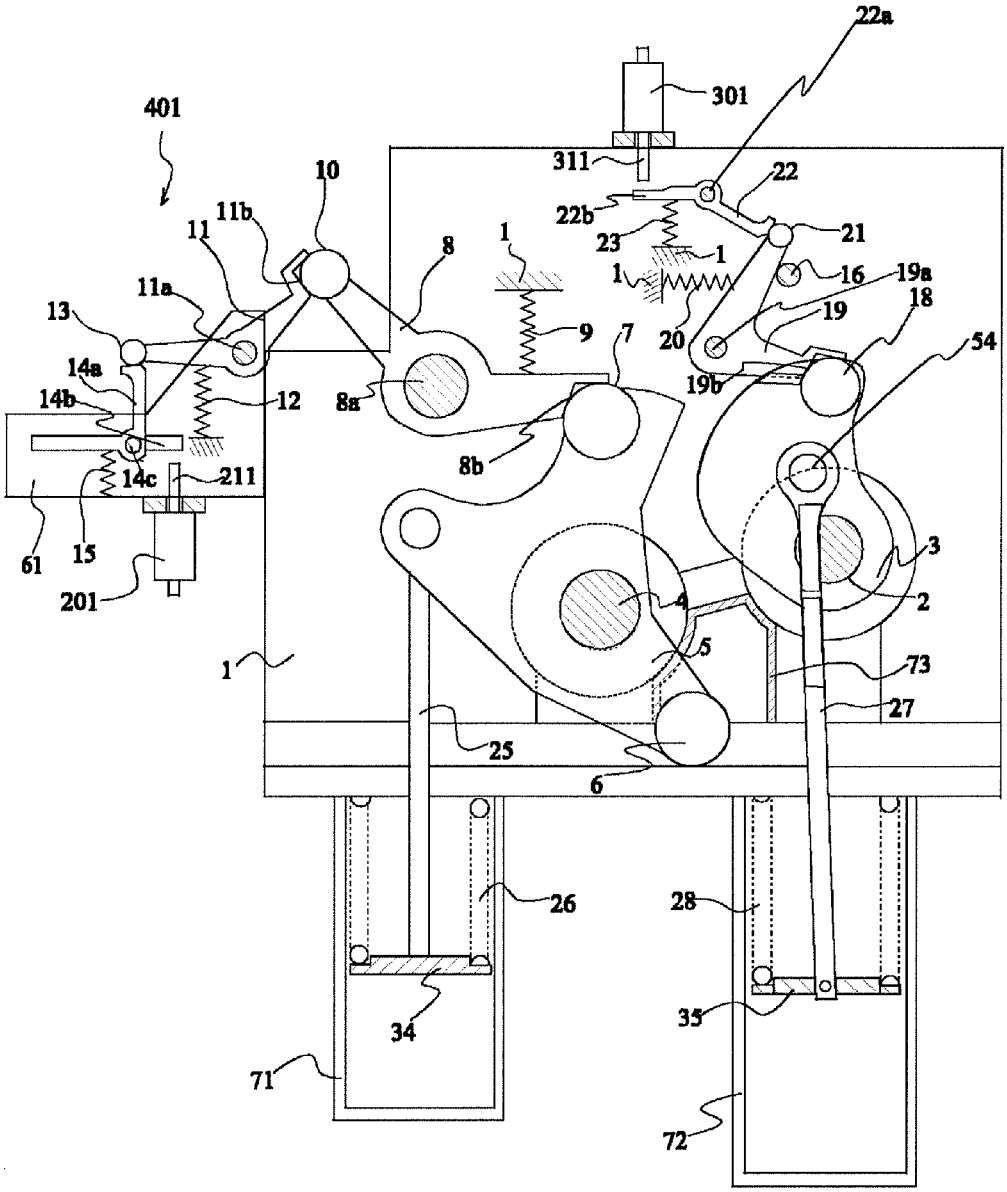
FIG. 1 shows a state where a connection is maintained between contacts in an opening section and each of an opening spring and a closing spring is in a compressed state.
Figure 2:
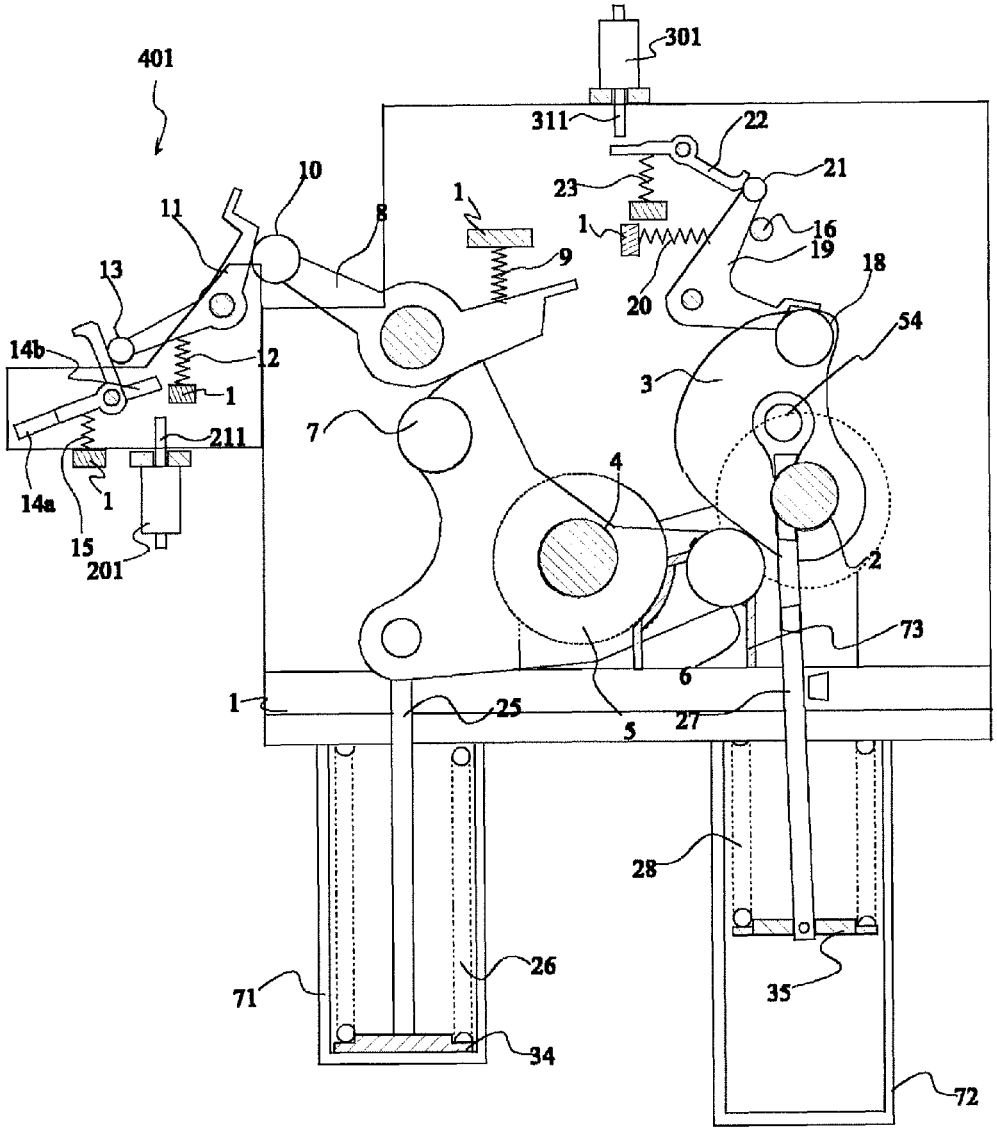
FIG. 2 shows a state where the opening spring is released by an opening operation from the state shown in FIG. 1.
Figure 3:
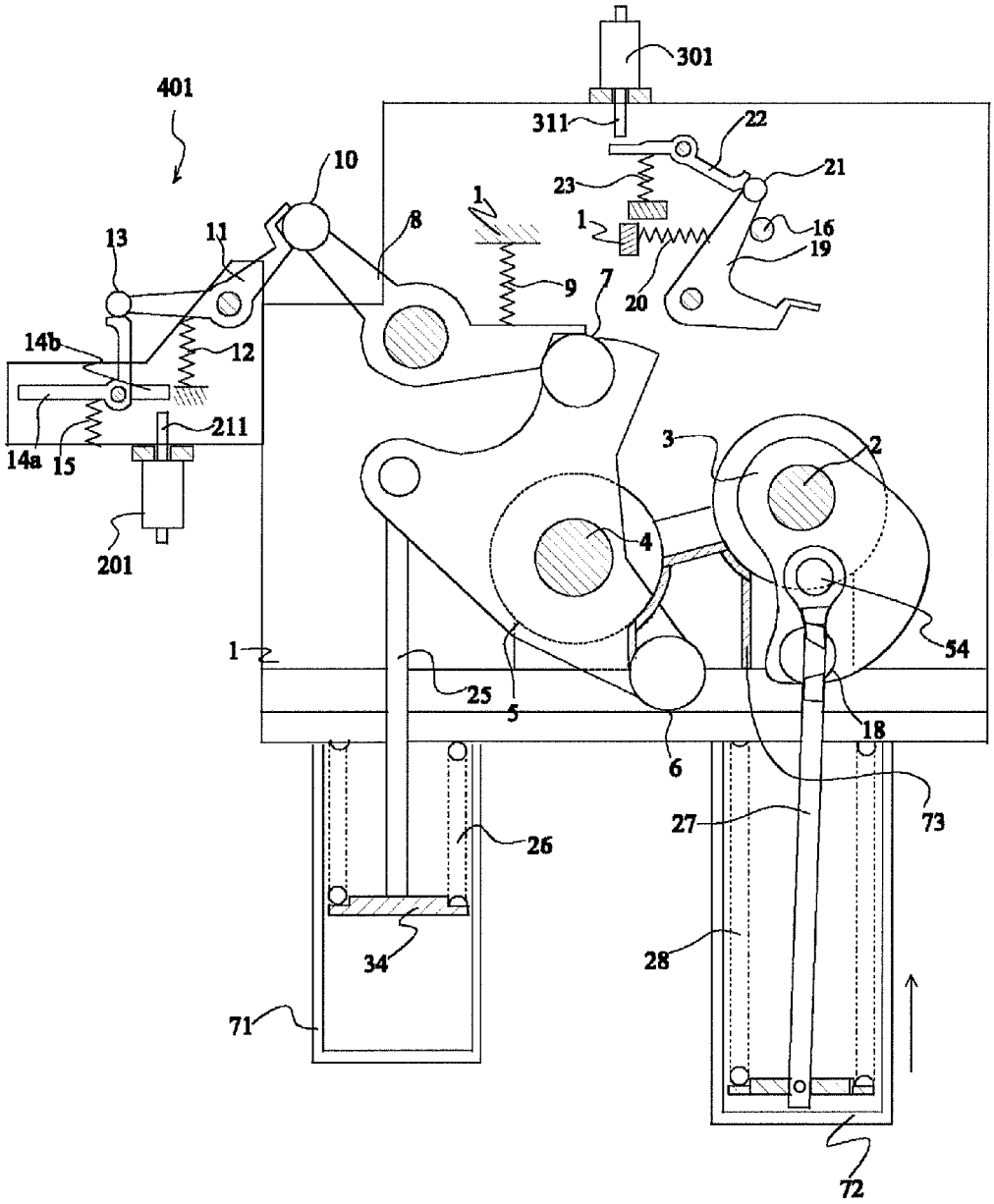
FIG. 3 shows a state where the closing spring is released by a closing operation from the state shown in FIG. 2, and where the opening spring is compressed.

FIG. 2 is a schematic diagram showing details of the spring operation mechanism shown in FIG. 5. The spring operation mechanism includes an opening spring 26, a closing spring 28, a closing control mechanism, an opening control mechanism, and a closing spring force accumulation device (not illustrated). FIG. 1 shows a turning-on state where both the closing spring 28 and the opening spring 26 of the spring operation mechanism are compressed.

The structure around the closing spring 28 is described with reference to FIG. 2. A cam 3 is attached to one end of a cam shaft 2 rotatably supported in a housing 1. One end 54 of a closing spring link 27 is rotatably attached to the cam 3. A closing spring seat 35 is attached to the other end portion of the closing spring link 27 and holds one end of the closing spring 28. One end of the closing spring 28 is disposed around the closing spring link 27 while the other end thereof is held as a fixed end on the housing 1. A cylindrical closing spring case 72 is provided, around the closing spring 28.

Next, the closing control mechanism will be outlined. A closing latch 19 is disposed engageably with a roller 18 attached to the cam 3. The closing latch 19 is generally V-shaped and has its bend portion rotatably attached to a shaft 19*a*. An engaging portion 19*b* capable of engaging with the roller 18 on the cam 3 is formed in the closing latch 19 at one end of the V-shape. A roller 21 is attached to the closing latch 19 at the other end of the V-shape.

Figure 4:
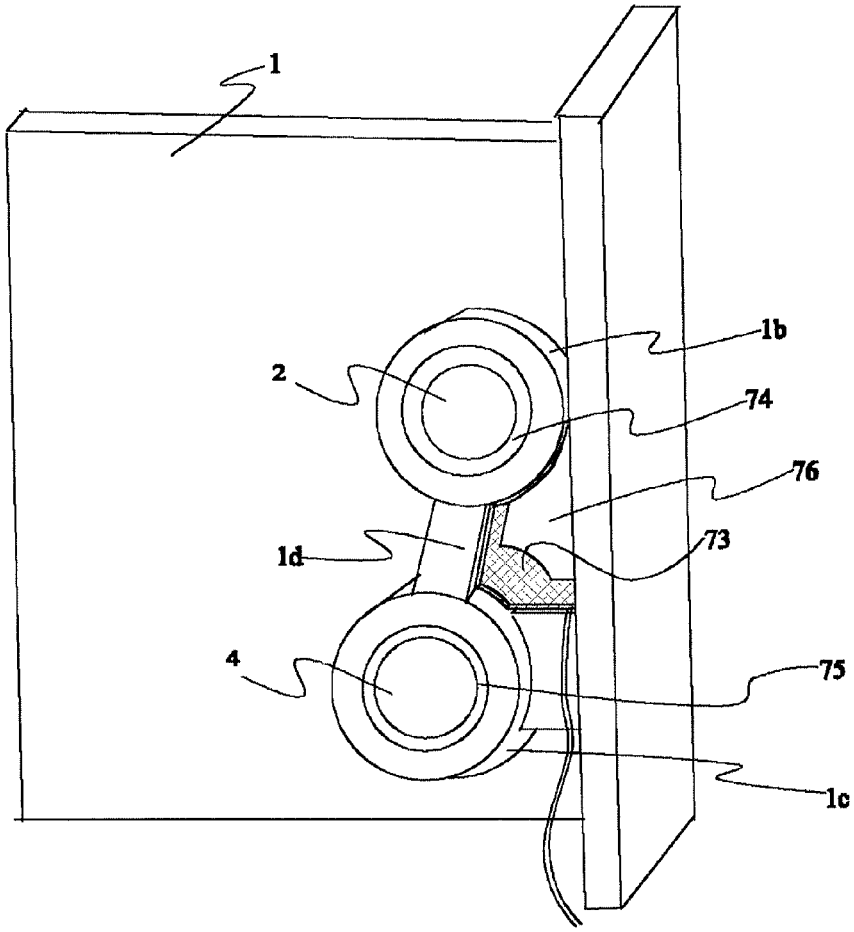
FIG. 4 is a perspective view showing a bracket portion of an operating mechanism.

A closing trigger 22 is disposed so that its one end portion can come in contact with the roller 21. The closing trigger 22 is formed into a bent shape, and its bent portion is rotatably mounted with a rotating shaft 22*a*. The rotating shaft 22*a* is rotatably supported on the housing 1. A return spring 20 having its one end fixed to the housing 1 is attached to an intermediate portion of closing latch 19 between the shaft 19*a* and the roller 21. A closing trigger 22*b* is formed on the closing trigger 22 opposite from the position at which the closing trigger 22 contacts the roller 21. A plunger 311 of a closing solenoid 301 is disposed so as to be capable of coming in contact with the closing trigger 22*b*. As shown in FIG. 4, the cam shaft 2 is supported by a bearing 74 in the housing 1.

Next, the structure around the opening spring will be described. An intermediate portion of a generally Y-shaped main lever 5 is attached to the main shaft 4. Rollers 6 and 7 are attached to two end portions of the generally Y-shaped main lever 5. One end of an opening spring link 25 is rotatably attached to a remaining end portion of the main lever 5. An opening spring seat 34 made of a metal is attached to the other end of the opening spring link 25 and holds the coiled opening spring 26 disposed around the opening spring link 25. The opening spring 26 has a free end portion held by the opening spring seat 34 and a fixed end portion opposite to the free end portion and held on the housing 1. A cylindrical opening spring case 71 is provided around the opening spring 26.

The opening control mechanism holds and releases an opening spring force. The opening control mechanism will be outlined (see FIG. 1). A second opening latch 8 having its intermediate portion rotatably attached to a shaft 8*a* fixed on the housing 1 has an engaging portion 8*b* formed at its one end. The second opening latch 8 engages by its engaging portion 8*b* with the roller 7 provided on one end of the generally Y-shaped main lever 5. A roller 10 is attached to the other end portion of the second opening latch 8. The second opening latch 8 is limited into a shape which is bent at the shaft 8*a*. One end portion of a return spring 9 for returning the second opening latch 8 to a home position is attached to an intermediate portion of the second opening latch 8 between the shaft 8*a* and the engaging portion 8*b* of the second opening latch 8. The other end portion of the return spring 9 is fixed to the housing 1.

An opening latch 11 is disposed engageably with the roller 10 provided on one end of the second opening latch 8. An intermediate portion of the opening latch 11 is rotatably attached to a shaft 11*a* supported on a small housing 61. The opening latch 11 is formed into a shape which is bent at the shaft 11*a*. One end portion of a return spring 12 for returning the opening latch 11 to a home position is attached to an intermediate portion of the opening latch 11 between the shaft 11*a* and an end of the opening latch 11 to which a roller 13 is attached. The other end of the return spring 12 is fixed to the small housing 61. The opening latch 11 has an engaging portion 11*b* engageable with the roller 10 opposite from the end to which the roller 13 is attached. A distal end portion of an opening trigger 14*a* Which is generally L-shaped so as to be engageable with the roller 13 contacts the roller 13. This distal end portion is formed so as to have a curved surface.

A portion of the opening trigger 14*a* at the corner of a generally L-shape is attached to a shaft 14*c* rotatably supported on the small housing 61. A trigger lever 14*b* extending horizontally is attached to the shaft 14*c*. A plunger 211 of a tripping solenoid 201 is disposed so as to be capable of contacting with this trigger lever 14*b*. A return spring 15 for returning the opening trigger 14*a* to a home position is attached to an intermediate portion of the opening trigger 14*a*, with one end of the return spring 15 fixed to the small housing 61. Each of the return springs 9, 12, and 15 is in a compressed state in the situation shown in FIG. 2, While these return springs are assumed to be coil springs in the present embodiment, they may alternatively be torsion coil springs or disc springs for example.

As shown in FIG. 4, a boss 1*c* is provided on the housing 1 as a main shaft holding member on which the main shaft 4 is held and a boss 1*b* is also provided on the housing 1 as a cam shaft holding member on which the cam shaft 2 is held. A rib 1*d* is also provided between these bosses as a member connecting these bosses. A through hole 76 is provided between the bosses 1*b* and 1*c* and a heat generating member 73 in the form of a sheet is provided along a surface therein. The heat generating member 73 is connected to a power supply (not illustrated). The heat generating member is, preferably, a thin, flexible member, i.e., a heater in sheet form, because there is a need to heat boss portions of the frame.

In the closing operation of the breaker, the contacts are connected by releasing the closing spring while the opening spring is compressed, as described below in detail. There is, therefore, a possibility of the influence of a change in slide resistance, for example, due to a change in ambient temperature in the closing operation being larger than that in the opening operation. Accordingly, it is preferable to provide a heat generating member on the boss 1*b* around the cam shaft 2 for transmission of the drive force of the closing spring.

The opening operation of the gas circuit breaker 100 configured as described above will be described below. When an opening command is input in the closing state, the gas circuit breaker 100 starts the opening operation. The tripping solenoid 201 in the opening control mechanism 401 is energized to project the plunger 211. The plunger 211 presses the trigger lever 14*b*. As a result, the opening trigger 14*a* and the opening latch 11 are disengaged from each other.

The opening latch 11 disengages from the opening trigger 14*a* and becomes turnable. Since the opening latch 11 is pressed by the roller 10 on the second opening latch 8, the opening latch 11 is turned right-handed on the shaft 11*a*. The second opening latch 8 having been stopped from turning is made turnable and is turned right-handed on the shaft 8*a* by the pressing force from the roller 7 on the main lever 5. The roller 7 on the main lever 5 and the second opening latch 8 are disengaged from each other and the main lever 5 is made turnable. Stopping of the opening spring 26 in the compressed state is then discontinued and the force of the opening spring 26 is released to turn the main lever 5 clockwise, thus separating the contacts in the breaker section in the opening operation. After the force of the opening spring 26 is completely released, the opening operation ends. The main lever 5 stops, with the roller 6 on the end portion of the main lever 5 brought into substantial contact with the peripheral surface of the cam 3.

Next, the operation at the time of transition from the separated state to the connected state of the contacts in the breaker will be described. When a closing command is input to the gas circuit breaker 100, the closing solenoid 301 is energized. The plunger 311 of the closing solenoid 301 is projected to press the closing trigger 22. The closing trigger 22 is turned clockwise and the roller 21 on the closing latch 19 and the closing trigger 22 are disengaged from each other. The closing latch 19 having been stopped from turning is made turnable and the closing latch 19 is turned clockwise by the pressing force from the roller 18 on the cam 3. The closing latch 19 and the roller 18 on the cam 3 are then disengaged from each other. Stopping of rotation of the cam 3 is discontinued and the spring force of the closing spring 28 is therefore released. The closing spring link 27 is moved leftward and the cam shaft 2 and the cam 3 are turned clockwise.

With the turning of the cam 3, the peripheral surface of the cam 3 comes in contact with the roller 6 on the main lever 5. The main lever 5 turns counterclockwise. When the cam 3 makes an approximately half revolution, the peripheral surface of a maximum curvature-radius portion of the cam 3 comes in contact with the roller 6 on the main lever 5. At this time, the opening spring link 25 connected to the main lever 5 compresses the opening spring 26 substantially to the original position. After the force of the closing spring 28 is completely released, the contacts in the breaker are connected. When the closing operation is completed, the levers 8, 11, and 14 of the opening control mechanism 401 are returned to the home positions by the forces of the return springs 9, 12, and 15, thereby accumulating force in the opening spring 26.

Under a low-temperature condition in an extremely cold region, the viscosity of grease enclosed in the bearing 74 supporting the cam shaft 2 increases. However, the increase in the viscosity of the grease as well as the increase in a slide resistance of the cam shaft 2 can be restricted by directly heating the housing 1 with the sheet-shaped heat generating member 73 as described in the present embodiment. The difference in contact closing time between an ordinary temperature condition and the low-temperature condition can thereby be reduced. Furthermore, the increase in the viscosity of the grease enclosed in the shaft bearing 75 supporting the main shaft 4 can also be restricted in the same way in the opening operation. The difference in the contact closing time between the ordinary temperature condition and the low-temperature condition can thereby be reduced. The stability of the operation in an extremely cold region of the gas circuit breaker according to the present invention can thus be improved.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A gas circuit breaker comprising:

a pair of contactors disposed by being opposed to each other in a grounded container; and an operating mechanism including a closing spring and an opening spring for driving at least one of the pair of contactors in a closing direction and in an opening direction, respectively, by means of a link mechanism, wherein the operating mechanism includes a main shaft being a rotating shaft of a main lever connected to the opening spring; a cam shaft being a rotating shaft of a cam connected to the closing spring; a main shaft holding member holding the main shaft; a cam shaft holding member holding the cam shaft; and a bracket holding the main shaft holding member and the cam shaft holding member, wherein a through hole is provided in a portion of the bracket between the main shaft holding member and the cam shaft holding member, and wherein a heat generating member is provided at least on a portion of the through hole.

2. A gas circuit breaker comprising:

a pair of contactors disposed by being opposed to each other in a grounded container; and an operating mechanism including a closing spring and an opening spring for driving at least one of the pair of contactors in a closing direction and in an opening direction, respectively, by means of a link mechanism, wherein the operating mechanism includes a main shaft being a rotating shaft of a main lever connected to the opening spring; a cam shaft being a rotating shaft of a cam connected to the closing spring; a main shaft holding member holding the main shaft; a cam shaft holding member holding the cam shaft; and a bracket holding the main shaft holding member and the cam shaft holding member, wherein a reinforcing member for connecting the main shaft holding member and the cam shaft holding member is provided therebetween, wherein a through hole is provided in a region surrounded by the main shaft holding member, the cam shaft holding member, and the connecting reinforcing member, and wherein a heat generating member is provided at least on a portion of the through hole.

3. The gas circuit breaker according to claim 1, wherein the heat generating member is disposed at a side close to the cam shaft holding member in the through hole.

4. The gas circuit breaker according to claim 2, wherein the heat generating member is disposed at a side close to the earn shaft holding member in the through hole.

5. The gas circuit breaker according to claim 1, wherein the heat generating member is in the form of a sheet.

6. The gas circuit breaker according to claim 2, wherein the heat generating member is in the form of a sheet.

* * * * *